US009897418B2

(12) United States Patent
Evenblij et al.

(10) Patent No.: US 9,897,418 B2
(45) Date of Patent: Feb. 20, 2018

(54) ELECTRIC REACTIVE ARMOUR

(71) Applicant: Nederlandse Organisatie voor toegepast-natuurwetenschappelijk onderzoek TNO, 's-Gravenhage (NL)

(72) Inventors: Berend Hendrik Evenblij, 's-Gravenhage (NL); Petrus Jacobus Marie Heskes, 's-Gravenhage (NL); Andrè Marcel Diederen, 's-Gravenhage (NL); Frederik Johannes Hilvers, 's-Gravenhage (NL); Walterus Wilhelmus Johannes Borsboom, 's-Gravenhage (NL); Frederik M. Verhorst, 's-Gravenhage (NL)

(73) Assignee: Nederlandse Organisatie voor toegepast-natuurwetenschappelijk onderzoek TNO, 's-Gravenhage (NL)

( * ) Notice: Subject to any disclaimer, the term of this patent is extended or adjusted under 35 U.S.C. 154(b) by 0 days.

(21) Appl. No.: 15/315,917

(22) PCT Filed: Jun. 2, 2015

(86) PCT No.: PCT/NL2015/050396
§ 371 (c)(1),
(2) Date: Dec. 2, 2016

(87) PCT Pub. No.: WO2015/187013
PCT Pub. Date: Dec. 10, 2015

(65) Prior Publication Data

US 2017/0097212 A1 Apr. 6, 2017

(30) Foreign Application Priority Data

Jun. 2, 2014 (NL) ..... 2012932

(51) Int. Cl.
*F41H 5/007* (2006.01)
*F41H 5/04* (2006.01)

(52) U.S. Cl.
CPC ..... *F41H 5/007* (2013.01); *F41H 5/0442* (2013.01)

(58) Field of Classification Search
CPC ..... F41H 5/007
(Continued)

(56) References Cited

U.S. PATENT DOCUMENTS 7,946,211 B1 5/2011 Winchester et al.
8,069,771 B1 12/2011 MacDougall
(Continued)

FOREIGN PATENT DOCUMENTS

BG 566 Y1 9/2002
EP 1877720 A1 1/2008
(Continued)

OTHER PUBLICATIONS

Aug. 24, 2015—International Search Report and Written Opinion of PCT/NL2015/050396.

*Primary Examiner* — Stephen Johnson
(74) *Attorney, Agent, or Firm* — Banner & Witcoff, Ltd.

(57) ABSTRACT

An electric reactive armor (10) comprises a first electrode (1) and a second electrode (2) spaced apart from the first electrode, to which electrodes (1, 2) a high voltage can be applied so as to disrupt a charge contacting the electrodes. The second electrode (2) comprises an electrically conductive structure (21) having a plurality of surfaces (22) embedded in an insulating material (23), such that the charge jet penetrates successive surfaces of the electrically conductive structure. The electrically conductive structure (21) comprises a meandering structure and/or a structure of linked cavities, such as a honeycomb structure.

20 Claims, 5 Drawing Sheets

(58) Field of Classification Search
USPC ..... 89/36.17
See application file for complete search history.

(56) References Cited

U.S. PATENT DOCUMENTS

| | | | | |
|---|---|---|---|---|
| 8,074,554 | B1 | 12/2011 | MacDougall | |
| 8,091,464 | B1 | 1/2012 | Imholt et al. | |
| 2006/0012375 | A1 | 1/2006 | Kelsey et al. | |
| 2006/0196350 | A1 | 9/2006 | Bouet | |
| 2009/0199701 | A1 | 8/2009 | Wickert et al. | |
| 2011/0048221 | A1 | 3/2011 | Jung et al. | |
| 2012/0017754 | A1* | 1/2012 | Joynt ..... | F41H 5/007 89/36.02 |
| 2013/0213211 | A1* | 8/2013 | Fisher ..... | F41H 5/007 89/36.17 |

FOREIGN PATENT DOCUMENTS

| | | | |
|---|---|---|---|
| EP | 2290317 | A2 | 3/2011 |
| JP | 2002295996 | A | 10/2002 |
| WO | 2010082970 | A2 | 7/2010 |
| WO | 2011138025 | A1 | 11/2011 |

* cited by examiner

ELECTRIC REACTIVE ARMOUR

CROSS-REFERENCE TO RELATED APPLICATIONS

This application is a U.S. National Stage application under 35 U.S.C. § 371 of International Application PCT/NL2015/050396 (published as WO 2015/187013 A1), filed Jun. 2, 2015, which claims the benefit of priority to NL 2012932, filed Jun. 2, 2014. Benefit of the filing date of each of these prior applications is hereby claimed. Each of these prior applications is hereby incorporated by reference in its entirety.

FIELD OF THE INVENTION

The present invention relates to electric reactive armour (ELRA), a system for protecting a vehicle or a vessel containing such an electric reactive armour, a vehicle or a vessel provided with such a system. Furthermore the invention provides a method of protecting a vehicle or a vessel.

BACKGROUND

An electric reactive armour, comprises a first electrode and a second electrode spaced apart from the first electrode, to which electrodes a high voltage can be applied so as to disrupt a charge that impacts on the electric reactive armour. Such an armour is known from European Patent EP 1 877 720 & U.S. Pat. No. 8,006,607 (Fraunhofer-Gesellschaft).

The known armour is designed to protect an object from threats such as shaped charges, for example RPGs (Rocket Propelled Grenades). On impact, the charge of an RPG produces a high speed jet of typically molten metal, which has a high penetrating power. As a high voltage is applied to the electrodes, the jet effectively creates a short circuit when it has penetrated the first electrode and reaches the second electrode. As a result of the short circuit, a strong electrical current will flow through the jet, which gives rise to a magnetic field that in turn gives rise to a Lorentz force on the jet. This disturbs the jet and distorts its needle shape, thus significantly reducing its penetrating power.

European Patent EP 1 877 720 mentioned above discloses a second electrode which is made of a spatially heterogeneous material, such as open-pore aluminium foam. The patent states that the electrode material should have a very good electrical conductivity. Using such a spatially heterogeneous electrode material apparently causes electrode material to be displaced in a direction away from the longitudinal axis of the jet, thus increasing the disturbance of the jet. However, it has been found that this disturbance of the jet can be improved upon and that more effective disturbance arrangements are possible.

Bulgarian utility model application BG 103643 discloses an electric armour with two parallel walls and plurality of inclined, electrically conductive plates between the walls, at an angle of between 10 to 30 degrees to the walls. The inclined plates are mechanically connected to each other. One pole of an electric voltage source is connected to both walls and another pole is connected to a conductive element that runs in parallel with the walls, midway between the walls. The inclined plates are connected to the conductive element. When a projectile hits outer wall, this gives rise to electrical contact between an inclined plate and the wall arises. The publication discloses that the described solution results in immediate electrical contact after piercing or deformation, because of the minimal distance between the walls and the inclined plates. The contact continues during passage of the projectile through the armour. The plates also server to deflect the projectile.

SUMMARY

It is an object to overcome these and other problems of the Prior Art and to provide an electric reactive armour which causes a very effective disturbance of the shaped charge jet.

Accordingly, an electric reactive armour is provided, comprising a first electrode and a second electrode electrically insulated from the first electrode, to which electrodes a high voltage can be applied so as to disrupt a charge contacting the electrodes, which armour is characterised in that the second electrode comprises an electrically conductive structure having a plurality of surfaces embedded in an insulating material, such that the charge penetrates successive surfaces of the electrically conductive structure. Preferably the electrodes each comprise a metal plate, the metal plates extending in parallel to each other, and the surfaces extend in parallel with the metal plates in a stack of surfaces between the metal plates. In this way the largest number of surfaces can be realized in a distance D between the metal plates, given the distances between successive surfaces.

According to another aspect, an electric reactive armour is provided, comprising a first metal plate and a second metal plate insulated from the first metal plate. Preferably the second metal plate extends in parallel with the first metal plate. Insulating material is provided between the first and second plate and connectors are provided coupled to the first and second metal plate respectively, for applying an electric voltage between the first and second metal plate. An electrically conductive structure is provided comprising a plurality of layers of electrical conductor material located between the first and second metal plate embedded in the insulating material, the layers of electrical conductor material being electrically coupled to each other and preferably to the second metal plate. The layers of electrical conductor material are arranged such that a charge penetrating the first metal plate will penetrate the layers of electrical conductor material successively. Preferably, the first and second metal plate extend parallel to each other and the layers of electrical conductor material extend in parallel to the first and second metal plate.

By providing an electrically conductive structure having a plurality of surfaces embedded in an insulating material, such that a jet due the charge penetrates successive surfaces of the electrically conductive structure, it is accomplished that the electrical point of contact of the tip of the jet is renewed in a stepwise manner without need to interrupt the current. This stepwise renewal of the point of contact serves to destabilize the jet. It may cause the initially needle-shaped jet to form a series of relatively broad discs. That is, the electrical current caused by the stepwise penetration distorts the jet in such a manner, that it is blunted and effectively fragmented. As a result, the jet will penetrate the second electrode is penetrated over a smaller distance and the jet may be stopped altogether. The more successive surfaces are used, the stronger the effect of destabilization of the jet.

The conductive structure also causes an early onset of the current, which further assists in the distortion of the jet.

In an embodiment the surfaces are electrically connected in series, configured such that, in case of a short circuit between the first electrode and one of the surfaces that is closest to the first electrode, a short circuit current to said one of the surfaces that is closest to the first electrode flows successively through successive ones of the surfaces that are successively closer to the first electrode. This reduces a delay involved with build up of current when the contact is renewed.

In an embodiment, the electrically conductive structure comprises a meandering structure. Such a meandering structure preferably has main surfaces which extend substantially parallel to each other, which main surfaces are connected by curved surfaces and/or by surfaces arranged at an angle of, for example, 900 relative to the main surfaces. A meandering structure has the advantage of being simple yet effective.

In an embodiment, the electrically conductive structure comprises a structure of linked cavities, such as a honeycomb structure. Each cavity may extend substantially through the width of the structure, or may be small relative to said width, and is on several sides surrounded by conductive surfaces.

In an advantageous embodiment, the electrically conductive structure comprises a plurality of electrically conductive elements made of conductive foil, such as metal foil. The electrically conductive elements may each constitute a hexagonal cylinder or a hexagonal torus. In such embodiments, the conductive structure may be constituted by stacking three-dimensional elements, such as cylinders. It is noted that other embodiments, such as the meandering conductive structure mentioned above, may also be made of conductive foil.

In preferred embodiments, the second electrode further comprises a base element on which the electrically conductive structure is mounted and to which it is electrically connected, which base element preferably comprises a solid metal plate. In these embodiments, the second electrode is constituted by both an embedded conductive structure for disrupting the charge, and a metal plate for providing mechanical protection. It will be understood that the embedded conductive structure is mounted in the base element in such a way that the structure faces the jet, so that the jet will reach the structure before it reaches the base element.

An armour as defined above is provided, further comprising a stripper plate arranged between the first electrode and the second electrode for reducing the width of the charge and/or for providing further mechanical resistance. The stripper plate may, for example, be made of metal, such as armour quality metal.

A system for protecting a vehicle or a vessel like an armoured boat is provided, the system comprising at least one high voltage source and an electric reactive armour as defined above.

A vehicle or vessel is provided with a system as defined above.

A method of protecting a vehicle or a vessel is provided, the method comprising the step of applying a system as defined above.

BRIEF DESCRIPTION OF THE DRAWING

These and other aspects will further be explained below with reference to exemplary embodiments illustrated in the accompanying drawings, in which.

DETAILED DESCRIPTION OF EXEMPLARY EMBODIMENTS

Figure 1:
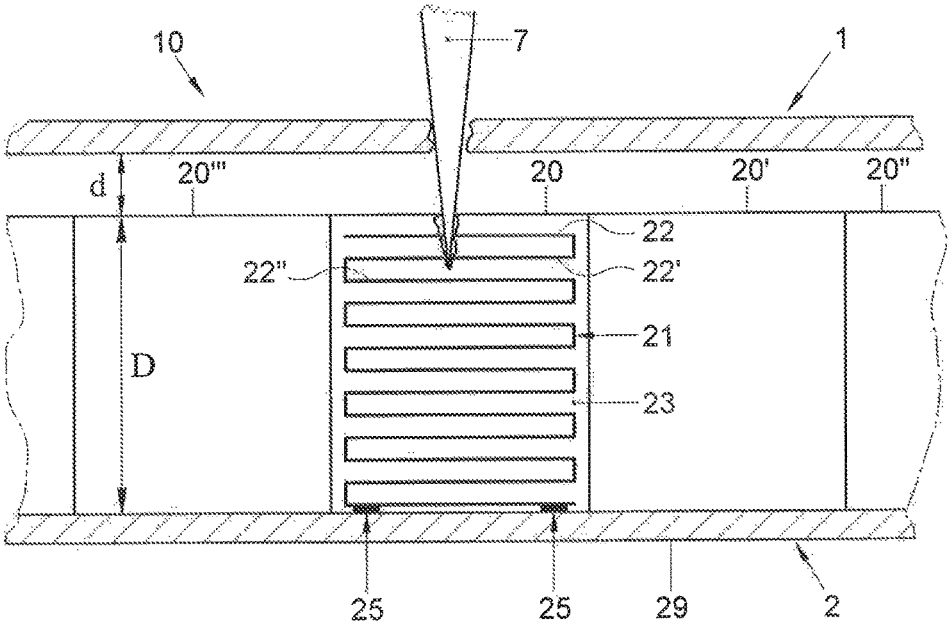
FIG. 1 schematically shows an embodiment of an electric reactive armour.

The electric reactive armour (ELRA) 10 shown merely by way of nonlimiting example in FIG. 1 comprises a first electrode 1 and a second electrode 2, which electrodes are spaced apart at a distance (D+d). First and second electrode 1, 2 comprise a first and second metal plate respectively. Furthermore, the electric reactive armour 10 comprises an electrically conductive structure 21, comprising a plurality of surfaces 22, i.e. layers of electrical conductor material, located between the first and second metal plate, extending transverse to a direction from the first metal plate to the second metal plate, preferably in parallel to the first and second metal plate The plurality of surfaces 22 of the electrically conductive structure 21 are in electrical contact with the second metal plate, and normally electrically isolated from the first metal plate. Because of this, the electrically conductive structure 21 may be considered to be part of the second electrode 2. As shown, a plurality of electrically conductive structures 21 may be provided in parallel at different locations on the second metal plate. The figures only show a section of the electric reactive armour wherein one or more of these electrically conductive structures 21 are present, but it should be appreciated that the electric reactive armour may extend further and more electrically conductive structures 21 may be present.

Figure 1A:
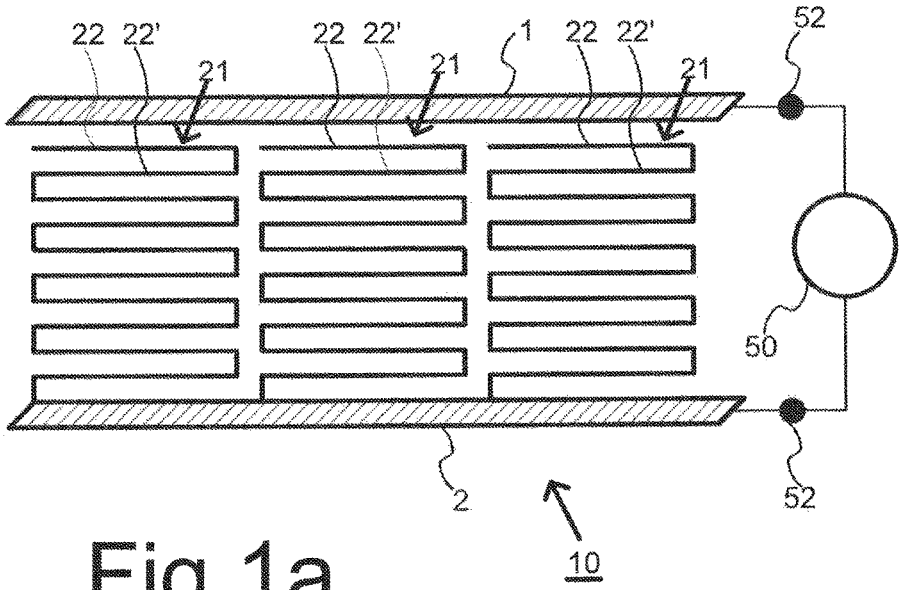
FIG. 1*a* shows an armour system for protecting a vehicle or a vessel

FIG. 1*a* schematically shows an armour system comprising such an electric reactive armour 10 and an electrical power source 50 connected between the first electrode 1 and the second electrode 2. The electric reactive armour 10 may comprise connectors 52 coupled to first electrode 1 and a second electrode 2 for electrically connecting electrical power source 50 to first electrode 1 and a second electrode 2. Electrical power source 50 may comprise a capacitor connected between first electrode 1 and a second electrode 2. A high electric voltage can be applied to the electrodes using a suitable electrical power source 50, such as a capacitor. Typical suitable voltages range between 1000 and 5000 V, depending on the application and on the dimensioning of the armour. The power source should be capable of supplying a strong current during a short period of time, for example 100 to 500 kA during 100 μs, or 1000 kA during 50 μs. When the power source comprises a capacitor, the capacitor may be located on the electrode side of the connectors 52. This reduces power dissipation by the connectors. Again, the current to be supplied will depend on the application and the dimensioning of the armour.

In a typical application, the first electrode 1 will face away from the object to be protected, such as the interior of a vehicle, a boat, a tank or other vessel, while the second electrode 2 will face towards said object. In the embodiment shown in FIG. 1, the first electrode 1 is constituted by a metal plate, made of armour quality metal. The second electrode 2 of FIG. 1 also comprises a metal plate 29, which preferably is also made of armour quality metal so as to resist bullets and other projectiles. As shown, the metal plates that form first and second electrode 1, 2 are preferably parallel to each other.

Some projectiles, however, are capable of producing a jet of molten metal upon impact. Such projectiles may be rocket propelled grenades (RPGs), the charge of which typically produces such a jet. Most armour plates are not capable of withstanding such charges, unless the plates are very thick. However, thick armour plates are necessarily heavy, and make it unfeasible to use such thick plates in vehicles, boats and other small vessels. Electric reactive armour (ELRA) is designed to destabilize or disrupt the jet of a charge as it penetrates the armour. The electric reactive armour is designed to disrupt the jet even more.

As shown in FIG. 1, the jet 7 of a charge penetrates the first electrode 1. The second electrode 2 comprises a series of arrangements 20, 20', 20" . . . , each constituted by an electrically conductive structure 21 having a plurality of surfaces 22 embedded in an insulating material 23. The surfaces 22 need not be designed to resist charges. Instead, the surfaces 22 are designed to be penetrated by the jet 7. However, a certain resistance to the jet 7 may be desirable in some embodiments. In preferred embodiments, however, the surfaces 22, 22', . . . , and typically the entire structure 21, is made of relatively thin electrically conductive foil.

As shown, the electrically conductive foil forms the surfaces 22, 22' . . . (i.e. layers of electrical conductor material) as well as the electrical connections between successive ones of the surfaces 22, 22' . . . at the edges of the surfaces 22, 22' . . . . Thus, a meandering current path will arise when a short circuit arises between the surface 22 nearest first electrode 1 and that first electrode 1. In successive surfaces (layers) 22, 22' . . . the current will flow alternately in opposite directions parallel to the plane of the first electrode 1, and towards the first electrode in alternate opposite sides of the surfaces (layers).

The current will flow through a first one of the surfaces in a first direction parallel with the plane of first electrode 1. Next the current flows in a direction towards that plane to an adjacent second one of the surfaces, at the edge of the surfaces where the foil runs from the first one of the surfaces to the second one of the surfaces. Next the current flows through the second one of the surfaces in a second direction parallel to said plane, but opposite to the first direction. This repeats for successive ones of the layers.

Alternatively, the edges of the surfaces may be electrically connected to supply conductors (not shown) that extend from the second electrode 2 in the direction of the first electrode 1. This has the effect that when a short circuit arises between a surface and first electrode 1, time is needed to build up electrical current. Use of a foil that meanders to form the surfaces has the advantage that less time is needed to build up current in successive surfaces once a short circuit has arisen between the surface closest to the first electrode 1 and that first electrode 1. More generally, this may be realized by a series connection of the surfaces 22, configured such that the electrical current flows successively through surfaces 22 that are successively closer to the first electrode 1.

It is noted that these surfaces (layers) are substantially parallel to the base plate 29 of the second electrode 2. It is further noted that the electrically conductive structure 21 is both mechanically and electrically connected to the (electrically conducting) base element 29 at connecting points 25. Each surface 22, 22' forms a layer of electrical conductor material (shown in cross-section), the layer being parallel to first and second electrodes 1, 2, as shown. Preferably, a stack containing a plurality of such layers is used.

When the jet starts penetrating the electric reactive armour it first penetrates first electrode 1, then the electrically insulating material and subsequently reaches the first surface 22 of the electrically conductive structure 21. As this electrically conductive structure is electrically connected to the second electrode 2, it is electrically connected to the power source 50 mentioned above. Accordingly, the jet 7 will create a short-circuit between the electrodes 1 and 2 through the electrically conductive structure 21 and the jet, thus causing a strong electrical current to flow through the jet from the surface 20 closest to the first electrode 1. After some time, the strong current may cause the surface 20 that is in contact with the jet (i.e. the electrical conductor layer) to evaporate at the contact due to the heat generated by the concentrated current at the contact with the jet. However, until this has happened a strong current flows through the jet. This strong current generates strong electromechanical forces which distort the jet. Initially the distortion is not sufficient to stop the jet from further penetrating the arrangement 20. This further penetration will cause the jet to reach the next surface 22', thus also causing a short-circuit via the next surface. All or at least most of the short circuit current will then flow into the jet through its contact with that next surface 22'. Meanwhile, the first surface 22 or at least its contact with the jet will be, or have been, at least partially destroyed by the jet 7. The point of contact between the jet 7 and the surface 22 is likely to have evaporated (and become a plasma). However, due to the next surface 22' being contacted by the jet 7, the first surface 22 is no longer necessary to conduct the current. The current through the jet commutates from the point of contact with surface 22 to the next point of contact with surface 22'. Thus a substantially continuous flow of current is guaranteed. Meanwhile, the length of the current path through the conductive structure 21 decreases, thus reducing its electrical resistance and thereby increasing the current.

This process of the jet 7 penetrating successive surfaces 22, 22', . . . continues until the jet reaches the metal base of the second electrode 2. In typical embodiments, the jet will be disrupted to such an extent by the time that it reaches the second electrode that it is no longer capable of significantly penetrating the metal plate part 29 of the second electrode 2.

As can be seen, the jet 7 of the charge penetrates successive surfaces of the electrically conductive structure, thus producing short-circuits in a stepwise manner. As each successive surface is damaged or destroyed by the jet, the next surface is used to conduct the short-circuit current. In this way, it is assured that the jet disrupting current is present over a relatively long distance. Thus, as a result of using a plurality of layers of electrical conductor material between the first and second electrode 1, 2, the current also keeps flowing through all or most of the length of the jet, from near its tip to its contact with the first electrode 1. Because the destabilizing effect of the current on the jet is strongest at the tip this improves the effect on the jet. The thickness of each surfaces (layer) 22 affects the time needed before the contact of the surface and the jet evaporates. Preferably, the combination of the thickness of surfaces (layers) 22 and their mutual distance is selected so that their contacts with an jet each evaporate in about the time that the tip of an average jet needs to travel the distance to the next surface (e.g. between 50% and 150% of that time). For example a combination of a thickness of about 1 micrometer and a distance of 1 millimeter may be used. The time needed for evaporation may scale with the square of the thickness of the surface (layer) 22, and hence the distance between successive surfaces 22 may also be scaled with the square of the thickness. An optimized combination may be determined experimentally by trying different thicknesses and measuring time dependence of the current, or by doing so for different distances.

In the embodiment of FIG. 1, the arrangements 20, 20', . . . have a height D and are separated from the first electrode 1 by an optional air gap having a height d. The total distance between the electrodes therefore is equal to (D+d). In case the air gap is omitted, the distance between the electrodes equals the height D of the arrangements 20. When the air gap is present, the first electrode 1 and the arrangement 20 are spaced apart by a distance d. When the air gap is not present, the first electrode 1 and the arrangement 1 are not spaced apart but are electrically insulating by the top layer of insulating material 23. It will be understood that in such embodiments this top layer will have to have a sufficient thickness in order to prevent undesired discharges.

Figure 2:
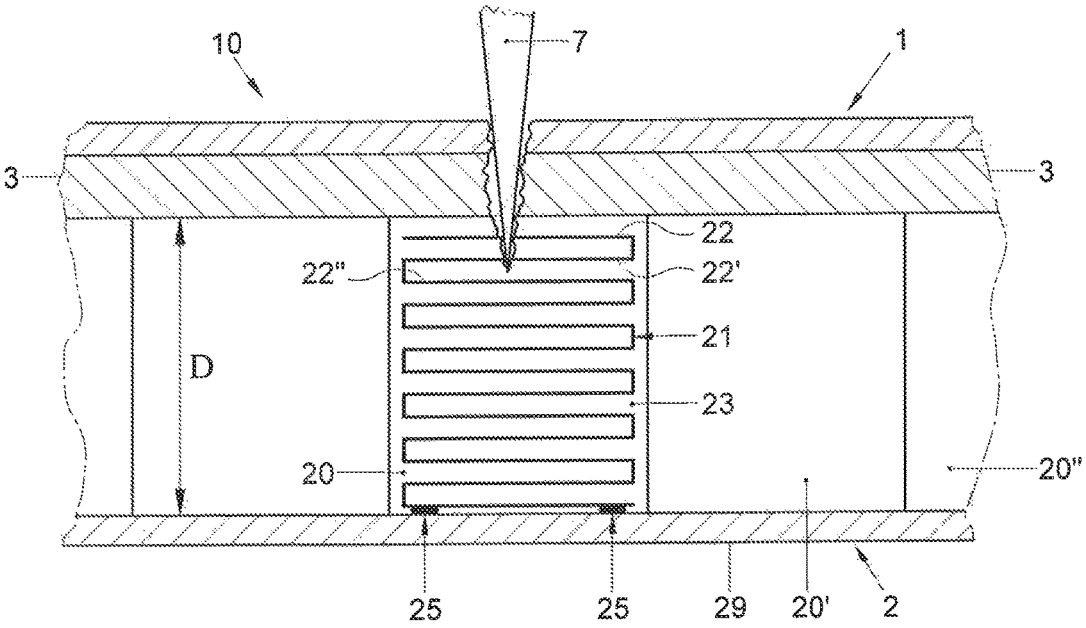
FIG. 2 schematically shows an alternative embodiment of an electric reactive armour, provided with a stripper plate.

The embodiment of FIG. 2 is essentially identical to the one of FIG. 1, with the exception of the stripper plate 3. This plate 3 is arranged between the first electrode 1 and the second electrode 2 to reduce the width of the jet 7. In the example of FIG. 2, the stripper plate 3 is shown to be penetrated by the jet 7. It will be understood that neither the stripper plate 3, nor the first electrode 1, will have an opening before being penetrated by the jet 7.

By providing mechanical resistance, the jet is slowed down and is reduced in width, thus mitigating its destructive effect. The stripper plate 3 is preferably made of armour quality steel or a similar material.

In FIGS. 3*a*-3*g* various embodiments of the electrically conducting structure 21 are schematically illustrated in side view.

Figure 3A:
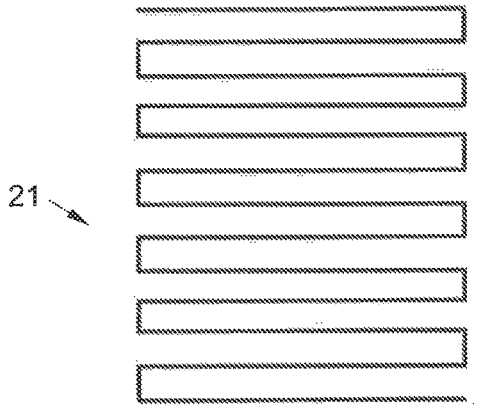
FIGS. 3*a*-3*g* schematically show various embodiments of the electrically conductive structure.
Figure 3B:
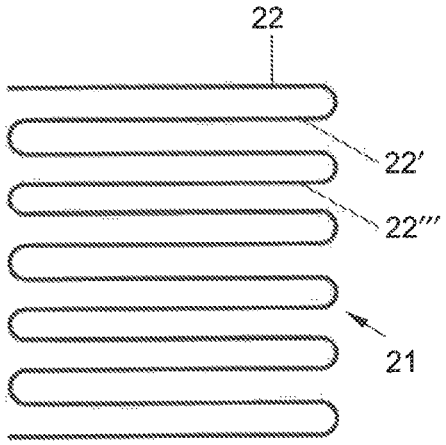

FIG. 3*a* shows a meandering structure with relatively sharp corners (angles of 900), while FIG. 3*b* shows a similar meandering structure with rounded corners. In both embodiments, the surfaces 22 (22', . . . ) are arranged substantially in parallel. In both embodiments, the surfaces 22 are electrically in series, and are connected by respective corner sections.

Figure 3C:
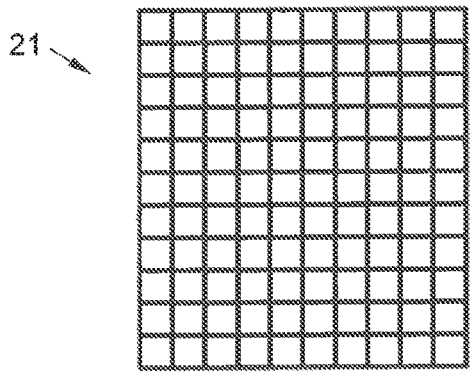

The embodiment of FIG. 3*c* constitutes a rectangular grid. The surfaces 22 are not only connected at their sides, but also at various places between these sides. In this way, the electrical current can be distributed over the structure.

Figure 3D:
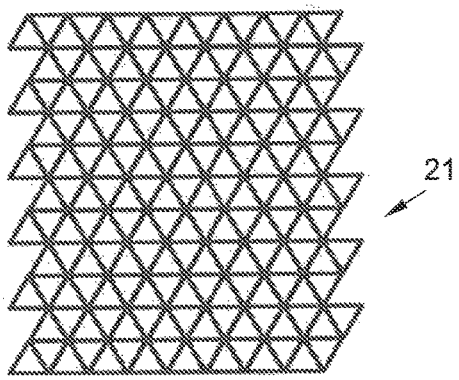
Figure 3E:
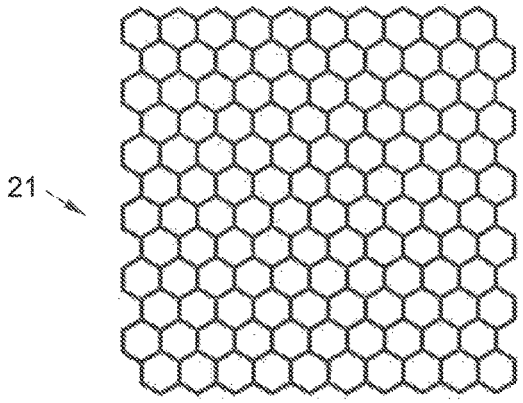
Figure 3F:
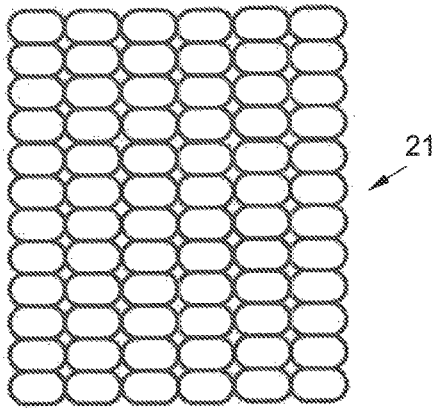
Figure 3G:
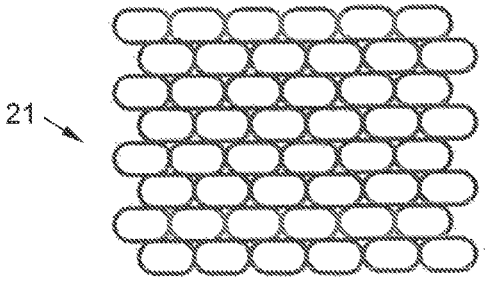

The embodiment of FIG. 3*d* is similar to that of FIG. 3*c*, but constitutes a triangular rather than a rectangular grid. A hexagonal grid is illustrated in FIG. 3*e*, while grids constituted by arrangements of rounded shapes are shown in FIGS. 3*f* and 3*g*.

In all embodiments, the distance between two successive surfaces 22, 22', in the penetration direction, preferably lies between approximately 20 and 5 mm and may advantageously lie between approximately 11 and 9 mm. A spacing of about 10 mm between the surfaces results in a time interval between two successive surface penetrations of about 1 μs. The present inventors have found this time interval to be advantageous for disrupting the jet while maintaining the current through the jet. However, other spacings can also be used, such as spacings larger than 20 mm.

The thickness of a surface 22 preferably lies between 20 and 5 μm, and may advantageously lie between 11 and 9 μm. A thickness of approximately 10 μm will result in an increased electrical impedance due to heating and/or evaporation, and will thereby assist in commutating the current to the next surface.

It is noted that the electrically insulating material (23 in FIG. 1), in which the structures are embedded to form arrangements 20, may comprise plastic foam or any other suitable material, for example (hard) plastic.

Figure 4A:
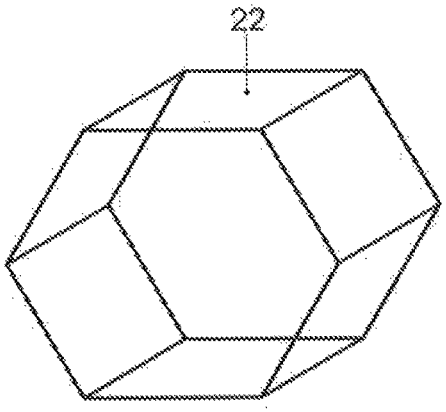
FIG. 4*a*-4*c* schematically show various embodiments of arrangements of surfaces for use in the electrically conductive structure.
Figure 4B:
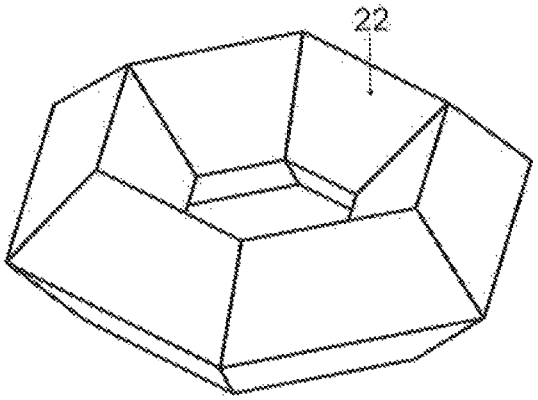
Figure 4C:
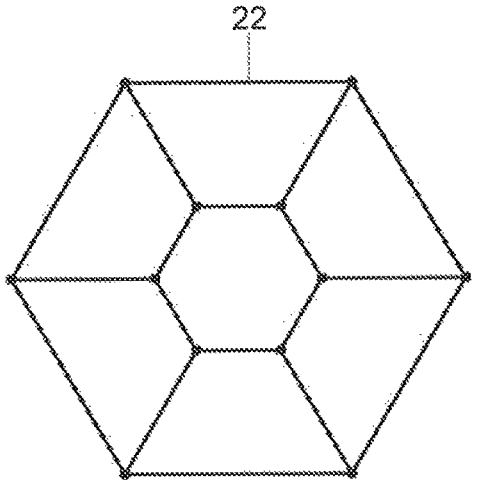

FIG. 3*e* already showed a hexagonal structure in plan view, as an embodiment of the electrically conductive structure 21. Such a hexagonal structure is shown in perspective in FIG. 4*a* and illustrates the type of elementary cell out of which the structure 21 can be made up. Another type of elementary cell is illustrated in FIG. 4*b*, which shows a torus structure in perspective. It will be understood that such torus 20 shaped elements can be stacked to form the conductive structure 21. A similar structure is shown in plan view in FIG. 4*c*. These structure can all be embedded in electrically insulating material to form arrangements 20.

The surfaces of the electrically conductive structure may be constituted by sheets of materials, such as metal foil. The surfaces will be electrically interconnected so as to provide a single electrically conductive structure.

The armour is based upon the insight that electrically conducting surfaces, which are electrically connected and embedded in an electrically insulating material, cause a stepwise shortening of the electrical path of the current through the electrode as it is pierced by the charge. These electrically conducting surfaces constitute a structure which may be supported by the electrically insulating material. The stepwise shortening of the electrical path causes a very effective disruption of the charge.

It is noted that any terms used in this document should not be construed so as to limit the scope of the present invention. In particular, the words "comprise(s)" and "comprising" are not meant to exclude any elements not specifically stated. Single (circuit) elements may be substituted with multiple (circuit) elements or with their equivalents.

It will be understood by those skilled in the art that the present invention is not limited to the embodiments illustrated above and that many modifications and additions may be made without departing from the scope of the invention as defined in the appended claims.

The invention claimed is:

1. An electric reactive armor, comprising a first electrode and a second electrode electrically insulated from the first electrode, between which electrodes an electric voltage can be applied so as to disrupt a charge contacting the electrodes, wherein the second electrode comprises an electrically conductive structure having a plurality of parallel surfaces embedded in an insulating material, such that the charge penetrates successive surfaces of said plurality of parallel surfaces of the electrically conductive structure, wherein the parallel surfaces are electrically connected in series in a series connection along the parallel surfaces, configured such that, in case of a short circuit between the first electrode and one of the parallel surfaces that is closest to the first electrode, a short circuit current to said one of the surfaces that is closest to the first electrode flows successively along successive ones of the parallel surfaces that are successively closer to the first electrode.

2. The armor according to claim 1, wherein the plurality of surfaces of the electrically conductive structure are made of a single metal foil, which extends successively along successive ones of the surfaces that are successively closer to the first electrode.

3. The armor according to claim 1, wherein the electrically conductive structure comprises electrical connections between successive ones of the parallel surfaces alternately on opposite edges of the surfaces.

4. The armor according to claim 1, wherein the second electrode further comprises a base element on which the electrically conductive structure is mounted and to which the electrically conductive structure is electrically connected, said base element comprising a solid metal plate.

5. The armor according to claim 1, wherein a distance between two successive surfaces of said plurality of surfaces, in a penetration direction, lies between 5 and 20 mm.

6. The armor of claim 5, wherein the distance between two successive surfaces of said plurality of surfaces, in the penetration direction, is between 9 mm and 11 mm.

7. The armor according to claim 1, wherein a distance between each pair of successive surfaces of said plurality of surfaces, in a penetration direction, lies between 5 and 20 mm.

8. The armor according to claim 7, wherein the distance between each pair of successive surfaces of said plurality of surfaces, in the penetration direction, is between 9 mm and 11 mm.

9. The armor according to claim 1, wherein a thickness of a surface of said plurality of surfaces lies between 5 and 20 μm.

10. The armor according to claim 9, wherein the thickness of the surface of said plurality of surfaces is between 9 μm and 11 μm.

11. The armor according to claim 1, wherein the first electrode is constituted by a solid metal plate.

12. The armor according to claim 1, wherein the first electrode is constituted by a first solid metal plate, and the second electrode comprising a second solid metal plate extending in parallel with the first solid metal plate, the surfaces each extending in parallel with said first and second solid metal plate.

13. The armor according to claim 1, further comprising a stripper plate arranged between the first electrode and the second electrode for reducing a width of the charge.

14. A system for protecting a vehicle or vessel, the system comprising at least one high voltage source and an electric reactive armor according to claim 1.

15. A vehicle or vessel provided with a system according to claim 14.

16. A method of protecting a vehicle or a vessel, comprising the step of applying a system according to claim 14.

17. An electric reactive armor, comprising:

a first electrode and a second electrode electrically insulated from the first electrode, between which electrodes an electric voltage can be applied so as to disrupt a charge contacting the electrodes, wherein the second electrode comprises an electrically conductive structure having a plurality of surfaces embedded in an insulating material, such that the charge penetrates successive surfaces of said plurality of surfaces of the electrically conductive structure, wherein the electrically conductive structure comprises a structure of linked cavities within the electrically conductive structure.

18. The armor according to claim 17, wherein the structure of linked cavities forms a honeycomb structure.

19. An electric reactive armor, comprising:

a first electrode and a second electrode electrically insulated from the first electrode, between which electrodes an electric voltage can be applied so as to disrupt a charge contacting the electrodes, wherein the second electrode comprises an electrically conductive structure having a plurality of surfaces embedded in an insulating material, such that the charge penetrates successive surfaces of said plurality of surfaces of the electrically conductive structure, wherein the electrically conductive structure comprises a plurality of electrically conductive elements made of electrically conductive foil, wherein the electrically conductive elements each constitute a hexagonal cylinder or a hexagonal torus.

20. An electric reactive armor, comprising a first metal plate and a second metal plate extending in parallel with the first metal plate and electrically insulated from the first metal plate, insulating material between the first and second plate, connectors coupled to the first and second metal plate respectively, for applying an electric voltage between the first and second metal plate, and an electrically conductive structure comprising a stack of a plurality of layers of electrical conductor material located between the first and second metal plate, embedded in the insulating material, each of the plurality of layers extending in parallel with the first and second metal plate, the plurality of layers being electrically coupled to each other and to the second metal plate.

* * * * *